US012305420B2

(12) United States Patent
Dimitrov

(10) Patent No.: US 12,305,420 B2
(45) Date of Patent: May 20, 2025

(54) SEISMIC RETROFIT SYSTEM

(71) Applicant: Vassil Dimitrov, Seattle, WA (US)

(72) Inventor: Vassil Dimitrov, Seattle, WA (US)

( * ) Notice: Subject to any disclaimer, the term of this patent is extended or adjusted under 35 U.S.C. 154(b) by 200 days.

(21) Appl. No.: 18/054,466

(22) Filed: Nov. 10, 2022

(65) Prior Publication Data

US 2024/0159075 A1 May 16, 2024

(51) Int. Cl.
*E04H 9/02* (2006.01)

(52) U.S. Cl.
CPC ..... *E04H 9/027* (2013.01)

(58) Field of Classification Search
CPC . E04H 9/027; E04H 9/021; E04B 2001/2644; F16B 12/50; F16B 2200/67
USPC ..... 52/167.1, 698, 699; 403/231; 248/200, 248/205.1, 205.3
See application file for complete search history.

(56) References Cited

U.S. PATENT DOCUMENTS 5,215,382 A * 6/1993 Kemeny ..... E04H 9/022 29/898.15
2009/0190996 A1* 7/2009 Clarke ..... F16B 2/065 403/231
2013/0048807 A1* 2/2013 Roberts ..... F16C 29/005 384/26

* cited by examiner

*Primary Examiner* — Gisele D Ford
(74) *Attorney, Agent, or Firm* — Barta Jones, PLLC

(57) ABSTRACT

A seismic washer and a seismic retrofit system including a seismic washer are provided. The seismic washer includes a fastener comprising a first opening and a washer fixedly attached to and extending from the fastener. The washer includes a second opening provided perpendicular to the first opening. The second opening is configured to receive a bolt that couples the washer to a structural building component. The seismic retrofit system includes the seismic washer and a seismic tie bracket comprising a first arm and a second arm. The first and second arms are disposed in intersecting planes to form an angle bracket. The fastener of the seismic washer is fixedly attached to the first and second arms of the seismic tie bracket proximate to the intersection of the first and second arms of the tie bracket.

20 Claims, 9 Drawing Sheets

SEISMIC RETROFIT SYSTEM

BACKGROUND

Seismic retrofitting refers to techniques for modifying existing structures (e.g., buildings) built prior to modern seismic building codes to improve resistance to lateral and vertical ground movement caused by seismic events such as earthquakes. Seismic retrofitting of older, lower-height buildings is commonly addressed by strengthening the connections between existing walls, floors, and frames to increase resistance to seismic forces. Some methods of retrofitting brick buildings involve bolting heavy steel straps banded around the exterior of the building and secured to the building via holes drilled through the bricks at intervals where interior floor joists meet the wall. This generally requires custom made steel straps and precise alignment of the holes punched in the steel with the holes in the bricks, while installation almost certainly requires the use of either a crane and one or more harnesses, or scaffolding to support workers bolting the steel straps to the building.

SUMMARY

This summary is provided to introduce simplified concepts concerning seismic retrofit systems for buildings, embodiments of which are further described below in the Detailed Description. This summary is not intended to identify key or essential features of the claimed subject matter, nor is it intended for use in determining the scope of the claimed subject matter. Furthermore, the claimed subject matter is not limited to implementations that solve any or all disadvantages noted in any part of this disclosure.

Disclosed herein are embodiments of a seismic washer and a seismic retrofit system including a seismic washer are provided. The seismic washer includes a threaded fastener comprising a first opening and a plate washer fixedly attached to and extending from the threaded fastener. The plate washer includes a second opening provided perpendicular to the first opening. The second opening is configured to receive a bolt that couples the plate washer to a structural building component. The seismic retrofit system includes the seismic washer and a seismic tie bracket comprising a first arm and a second arm. The first and second arms are disposed in intersecting planes to form an angle bracket. The threaded fastener of the seismic washer is fixedly attached to the first and second arms of the seismic tie bracket proximate to the intersection of the first and second arms of the tie bracket.

The foregoing and other objects, features, and advantages of the inventions will become more apparent from the following detailed description, which proceeds with reference to the accompanying figures.

BRIEF DESCRIPTION OF THE DRAWINGS

The present description will be better understood from the following detailed description read in light of the accompanying drawings, wherein:

Corresponding reference characters indicate corresponding parts throughout the drawings. In FIGS. 1-6, the systems are illustrated as schematic drawings. The drawings may not be to scale.

DETAILED DESCRIPTION

Figure 1A:
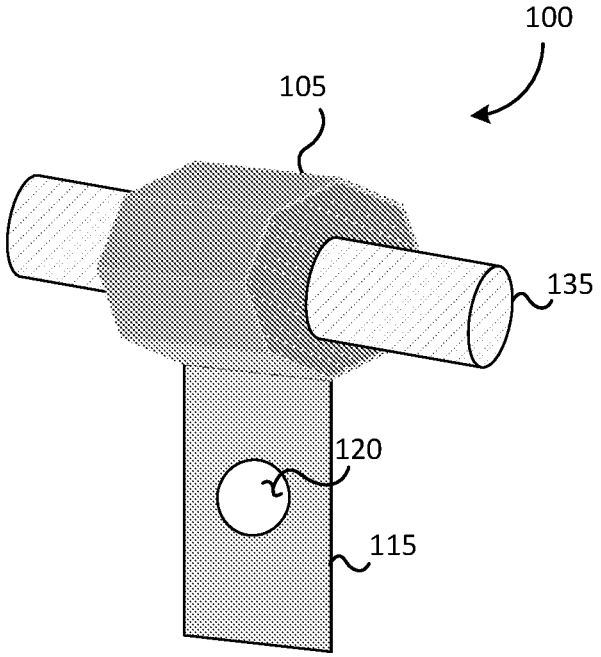
FIG. 1A illustrates a perspective view of an example seismic washer.

Seismic retrofitting for buildings is used to improve resistance to lateral and vertical ground movement caused by seismic events such as earthquakes. Current iterations of seismic retrofitting strengthens the connections between existing walls, floors, and frames to increase resistance to seismic forces. This is typically performed by bolting steel straps banded around the exterior of the building and secured to the building via holes drilled through the bricks at intervals where interior floor joists meet the wall. However, this requires custom made steel straps and precise alignment of the holes punched in the steel with the holes in the bricks, while installation requires the use of either a crane and one or more harnesses, or scaffolding to support workers bolting the steel straps to the building.

Aspects of the present disclosure provide systems and methods for securing a building floor to a wall using a seismic tie bracket and a seismic washer. This method of seismic retrofitting can be prohibitively expensive to the building owner, and can possibly lead to condemnation of the building and forcing the occupants to leave. There is a need for less expensive approaches to seismic retrofitting of such buildings and the inventions described herein are directed at simplifying the problems associated with seismic retrofitting of buildings.

The present disclosure recognizes and takes into account these challenges and provides systems, apparatuses, or methods for making and assembling components for retrofitting buildings to withstand seismic activity using a plurality of brackets and fasteners to tie floor joists or beams to supporting walls, and tie-rods connecting side walls with the brackets affixed to the floor joists to prevent movement of the joists relative to each other, and relative to the side walls during seismic events. For example, the present disclosure provides a specialized seismic washer that includes a threaded fastener with a first opening and a plate washer attached to and extending from the threaded fastener which includes a second opening. A first threaded bolt, or rod, may be provided through the first opening of a series of the seismic washer along a structural building component, such as a wall, while a second threaded bolt, or rod, may be provided through the structural building component and the second opening to secure the series of seismic washers to the structural building component. The seismic washer may be fixedly attached to a first arm of a tie bracket. The tie bracket includes the first arm and a second arm, which is fixed to a second structural building component, such as a floor or ceiling. Due to the perpendicular arrangement of the first threaded bolt and the second threaded bolt, along with the seismic washer being fixed to the tie bracket which is fixed to each of the first and second structural building component, the connections between existing walls, floors, and frames are strengthened to more effectively resist seismic forces. The design of the seismic washer provides numerous advantages. For example, the seismic washer can be rotated clockwise or counterclockwise and/or shifted up or down on a threaded rod, or bolt, in order to quickly be placed into the proper position and angle between the wall and the floor or ceiling.

Figure 1B:
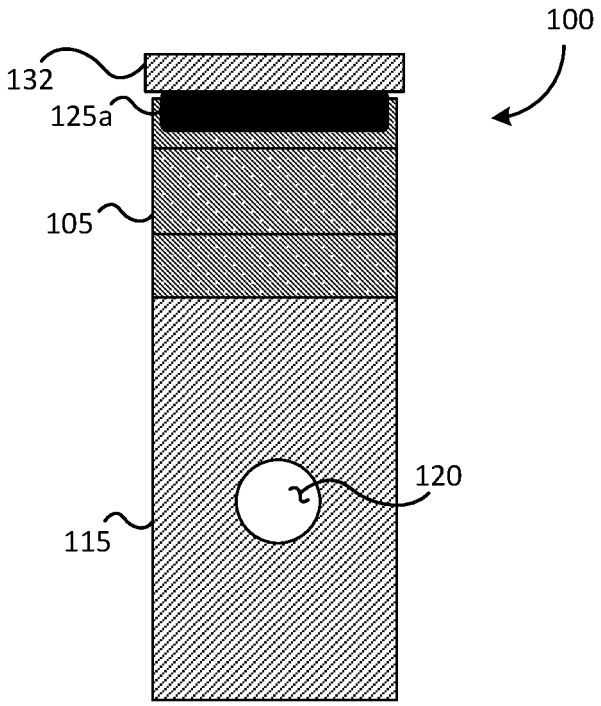
FIG. 1B illustrates an oblique view of an example seismic washer.
Figure 1C:
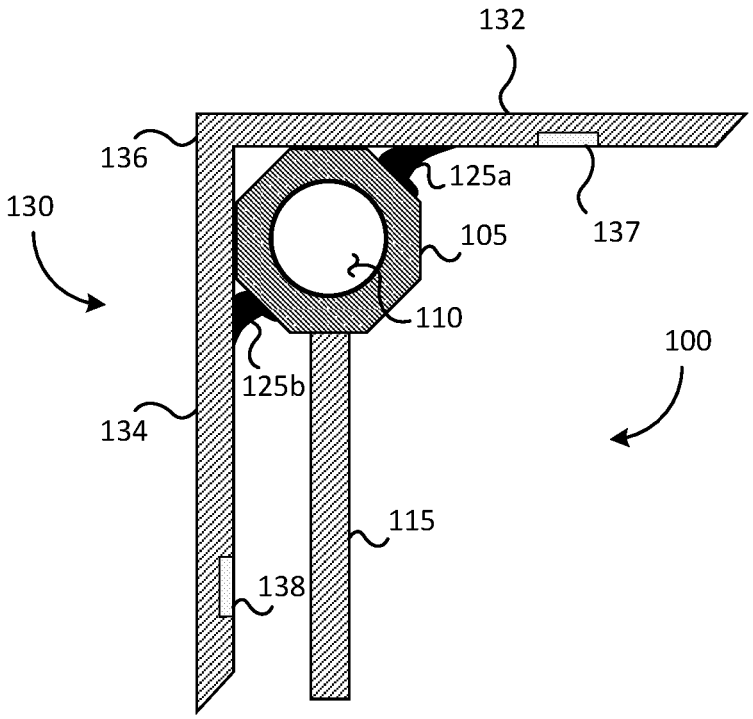
FIG. 1C illustrates a side view of an example seismic washer fixed to an example seismic tie bracket.

FIG. 1A illustrates a perspective view of a seismic washer. FIG. 1B illustrates an oblique view of a seismic washer. FIG. 1C illustrates a side view of a seismic washer fixed to a seismic tie bracket. The seismic washer 100 illustrated in FIGS. 1A-1C is provided for illustration only. Other examples of the seismic washer 100 may be used without departing from the scope of the present disclosure.

The seismic washer 100 includes a threaded fastener 105 and a plate washer 115. The interior of the threaded fastener 105 includes an opening 110, referred to herein as a first opening. In some examples, the opening 110 is threaded and configured to receive a threaded bolt 135. For example, in assembly, the threaded bolt 135 enters the opening 110 through a first side, threads through the opening 110, and extends through the opening 110 on a second side. In some examples, a single threaded bolt 135 is threaded through the opening 110 of a series of seismic washers 100. In some examples, the opening 110 is an aperture, hole, void, space, or otherwise lack of space in the threaded fastener 105.

In some examples, the threaded fastener 105 is hexagonal. However, this is provided as an example only and should not be construed as limiting. The threaded fastener 105 may be provided in any suitable shape without departing from the scope of the disclosure, including an octagonal shape, a circular barrel shape, a T-nut, a weld nut, a wing nut, and so forth.

The threaded bolt 135 may comprise the same material as the seismic washer 100 or a different material. For example, the threaded bolt 135 may comprise one or more of steel, titanium, zinc, nickel, chromium, chromate, aluminum, or a polymer material. The threaded bolt 135 may be any length suitable to pass through multiple iterations of the seismic washer 100. For example, the threaded bolt 135 may be one foot long, two feet long, three feet long, or greater. The threaded bolt 135 may be provided in any suitable thickness, such as ⅝ of an inch thick, ¾ of an inch thick, one inch thick, or greater.

The seismic washer 100 further includes a plate washer 115. The plate washer 115 extends from the threaded fastener 105. In some examples, the plate washer 115 is fixedly attached to the threaded fastener 105. For example, the plate washer 115 may be welded to the threaded fastener 105 or fixed to the threaded fastener 105 via an adhesive. In other examples, the plate washer 115 and the threaded fastener 105 are collectively a single piece. The plate washer 115 includes an opening 120, referred to herein as a second opening. In some examples, the opening 120 is threaded and configured to receive a threaded bolt 215, illustrated in FIGS. 2A-2C and described below. For example, in assembly, the threaded bolt 215 enters the opening 120 through a first side, threads through the opening 120, and extends through the opening 120 on a second side.

In some examples, as illustrated in FIG. 1A, the plate washer 115 may be provided in a square or rectangular shape. However, the rectangular plate washer 115 is provided as an example only and should not be construed as limiting. The plate washer 115 may be provided in any suitable shape without departing from the scope of the present disclosure, including a circular shape, a hexagonal shape, an octagonal shape, and so forth.

In some examples, an axis through the opening 110 is provided perpendicular to an axis through the opening 120. In other words, the threaded bolt 135 threaded through the first opening 110 is provided perpendicular to the threaded bolt 215 threaded through the second opening 120. This structural arrangement provides multi-faceted support to the structure of a building on which the seismic washer 100 is applied, as the threaded bolt 135 provides lateral support for multiple seismic washers 100 and the threaded bolt 215 provides direct support by being threaded through a structural building component as well as through the opening 120.

The seismic washer 100 may comprise one or materials including metal or polymer. For example, the components of the seismic washer 100, including the threaded fastener 105 and the plate washer 115, comprise one or more of steel, titanium, zinc, nickel, chromium, chromate, aluminum, or a polymer material.

The seismic washer 100 may be provided in any suitable size. In some examples, the plate washer 115 is three inches wide, three inches long, and one-quarter of an inch thick. However, the plate washer 115 may be larger or smaller than these dimensions without departing from the scope of the present disclosure. In some examples, the threaded fastener 105 is the same length as the plate washer 115 is wide. For example, where the plate washer 115 is three inches wide, the threaded fastener 105 is also three inches wide.

In some examples, the seismic washer 100 is provided proximate to a seismic tie bracket 130. For example, as illustrated in FIG. 1C, the seismic tie bracket 130 includes a first arm 132 and a second arm 134. The first arm 132 and the second arm 134 are disposed in intersecting planes to form an angle bracket. In some examples, the first arm 132 and the second arm 134 are disposed such that angle bracket is formed at a ninety-degree angle, or an angle that is approximately ninety-degrees. The threaded fastener 105 may be fixedly attached to the first arm 132 and the second arm 134 proximate to an intersection 136 of the first arm 132 and the second arm 134. For example, the threaded fastener 105 may be fixedly attached to the first arm 132 by a first fastener 125*a* and fixed attached to the second arm 134 by a second fastener 125*b*. The first fastener 125*a* and the second fastener 125*b* may be an adhesive, a weld, or any other suitable fastener.

Each of the first arm 132 and the second arm include at least one opening. For example, the first arm 132 includes at least one opening 137, also referred to herein as a third opening, and the second arm 134 includes at least one opening 138, also referred to as a fourth opening. The openings 137, 138 are configured for a fastener to be used to fasten the first arm 132 and the second arm 134, respectively, to a structural building component.

Figure 1D:
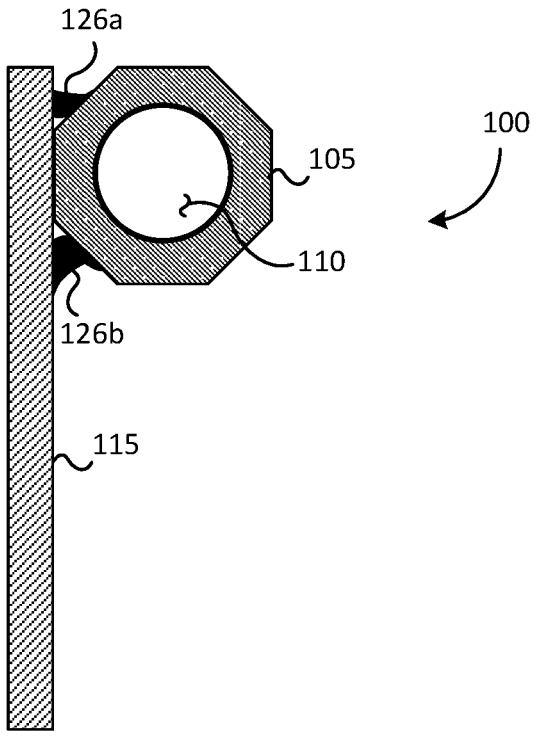
FIG. 1D illustrates an oblique view of another embodiment of an example seismic washer.

FIG. 1D illustrates an alternative example of a seismic washer 100. As shown in FIG. 1D, the plate washer 115 is offset relative to the threaded fastener 105. The plate washer 115 may be fastened to the threaded fastener 105 by a first fastener 126*a* and a second fastener 126*b*. The first fastener

126*a* and the second fastener 126*b* may be welds, an adhesive, or any other suitable means of fastening the plate washer 115 to the threaded fastener 105.

Figure 2A:
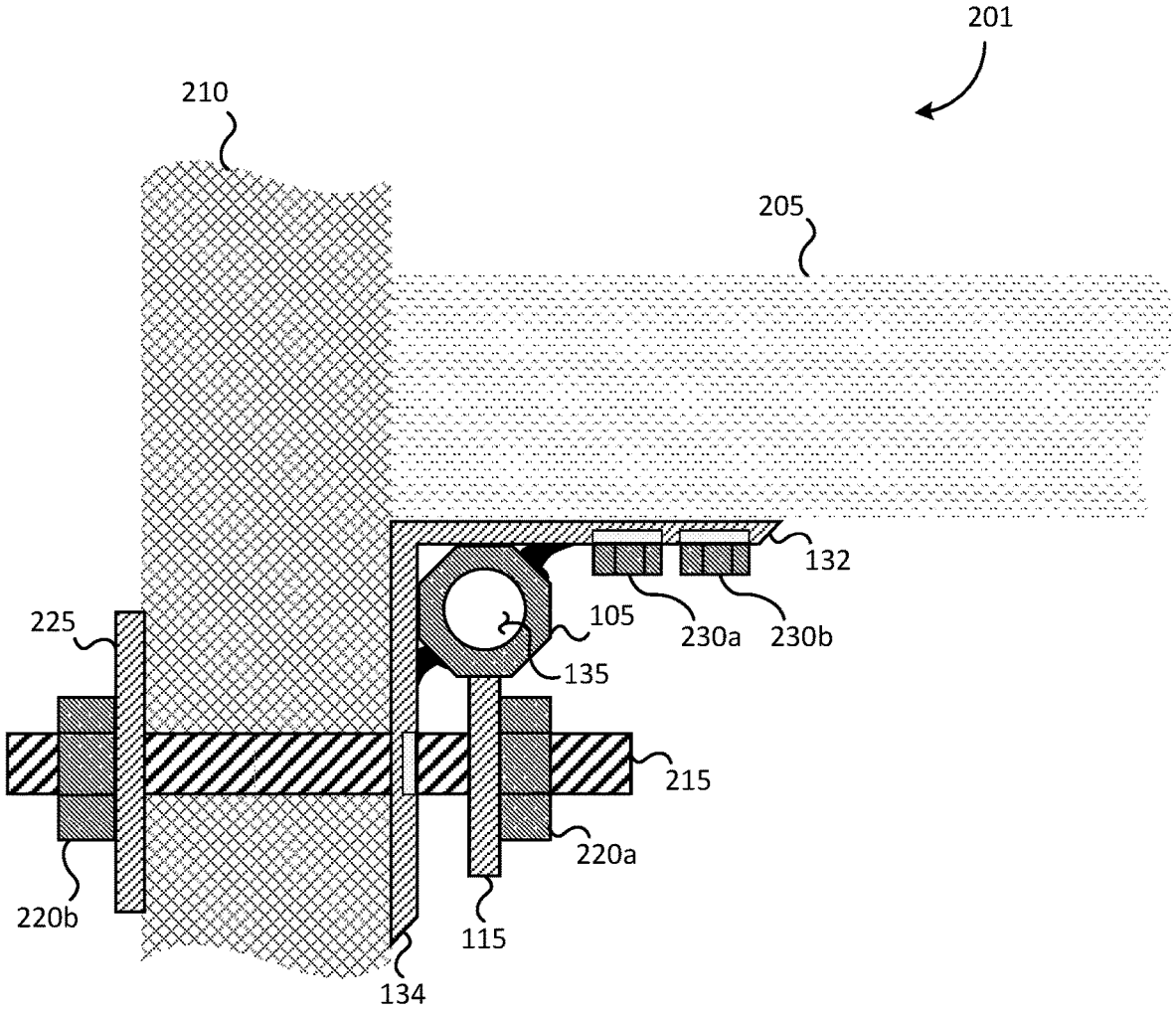
FIG. 2A illustrates a side view of an embodiment of an example system for securing a first structural building component to a second structural building component.

FIG. 2A illustrates a side view of an embodiment of a system 201 for securing a first structural building component to a second structural building component. The system 201 illustrated in FIG. 2A is provided for illustration only. Other examples of the system 200 may be used without departing from the scope of the present disclosure.

Figure 4:
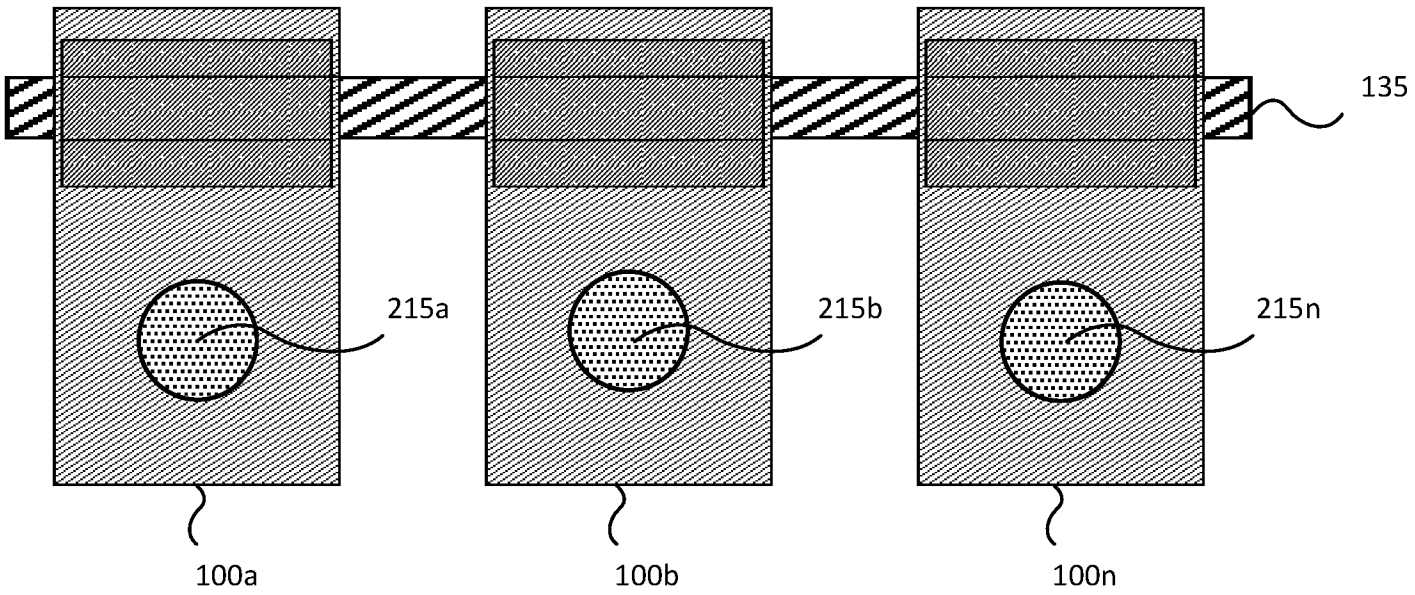
FIG. 4 illustrates an example threaded bolt including a plurality of seismic washers.

As shown in FIG. 2A, the system 201 includes the seismic washer 100 as illustrated in FIGS. 1A-1C. In other words, the system 201 includes the threaded fastener 105 and the plate washer 115. The threaded fastener 105 is provided inside the seismic tie bracket 130 within the angle created by the angle bracket between the first arm 132 and the second arm 134 and fixedly attached by the first fastener 125*a* and the second fastener 125*b*. The threaded bolt 135 is illustrated as threaded through the threaded fastener 105. In some examples, as illustrated in FIG. 4 below, the threaded bolt 135 is threaded through a series of the seismic washers 100, such that a series of seismic washers 100 are provided such that each plate washer 115 is parallel to the second structural building component 210.

The first arm 132 is fastened to a first structural building component 205 by a first fastener 230*a* and a second fastener 230*b* that are each provided through an iteration of the opening 137. It should be understood that although two fasteners 230 are illustrated in FIG. 2A, more or fewer than two fasteners 230 may be used to fasten the first arm 132 to the first structural building component 205 without departing from the scope of the present disclosure. For example, a single fastener 230 may be used, or three or more fasteners 230 may be used.

The second arm 134 is fastened to a second structural building component 210 by the threaded bolt 215. The threaded bolt 215 extends from an exterior of the second structural building component 210, through the second structural building component 210, the opening 138 of the second arm 134, and the opening 120 of the plate washer 115. The threaded bolt 215 is secured by a first fastener 220*a* fastened on the plate washer 115, such that the plate washer 115 is provided between the first fastener 220*a* and the second arm 134, and a second fastener 220*b* on the exterior of the second structural building component 210. In some examples, a washer 225 may be provided between the second fastener 220*b* and the second structural building component 210. In some examples, additional fasteners are provided to fasten the second arm 134 to the second structural building component 210, in addition to the threaded bolt 215. For example, additional iterations of the fastener 230 may be provided that fasten the second arm 134 to the second structural building component 210.

The threaded bolt 215 may comprise the same material as the seismic washer 100 or a different material. For example, the threaded bolt 215 may comprise one or more of steel, titanium, zinc, nickel, chromium, chromate, aluminum, or a polymer material. The threaded bolt 215 may be any length suitable to pass through each of the second structural building component 210, the second arm 134, and the plate washer 115 while the first fastener 220*a* and the second fastener 220*b* are each tightened on respective ends of the threaded bolt 215. The threaded bolt 215 may be provided in any suitable thickness, such as ⅝ of an inch thick, ¾ of an inch thick, one inch thick, or greater.

In some examples, the first structural building component 205 may be a floor or a ceiling, while the second structural building component 210 may be an interior wall or an exterior wall. The first structural building component 205 may comprise sheetrock, wood, laminate, vinyl, tile, brick, or any other suitable material that is used for a floor or ceiling. The second structural building component 210 may comprise brick, sheetrock, wood, tile, or any other suitable material that is used for an interior or exterior wall. In other examples, first structural building component 205 may be an interior wall or exterior wall, while the second structural building component 210 may be a floor or a ceiling.

In some examples, the system 201 includes a plurality of seismic washers 100 and seismic tie brackets 130 arranged in series along the intersection between the first structural building component 205 and the second structural building component 210. The arrangement of a plurality of seismic washers 100 and seismic tie brackets 130 arranged in series along the intersection provides continued support along the intersection that increases resistance of the joint to seismic forces.

In some examples, the system 201 includes an intermediate washer, such as one of the intermediate washers 235 described below. For example, an intermediate washer 235 having a size approximately the same as the space between the plate washer 115 and the second arm 134 may be provided between the plate washer 115 and the second arm 134 for additional stability and structural integrity of the system 201.

Figure 2B:
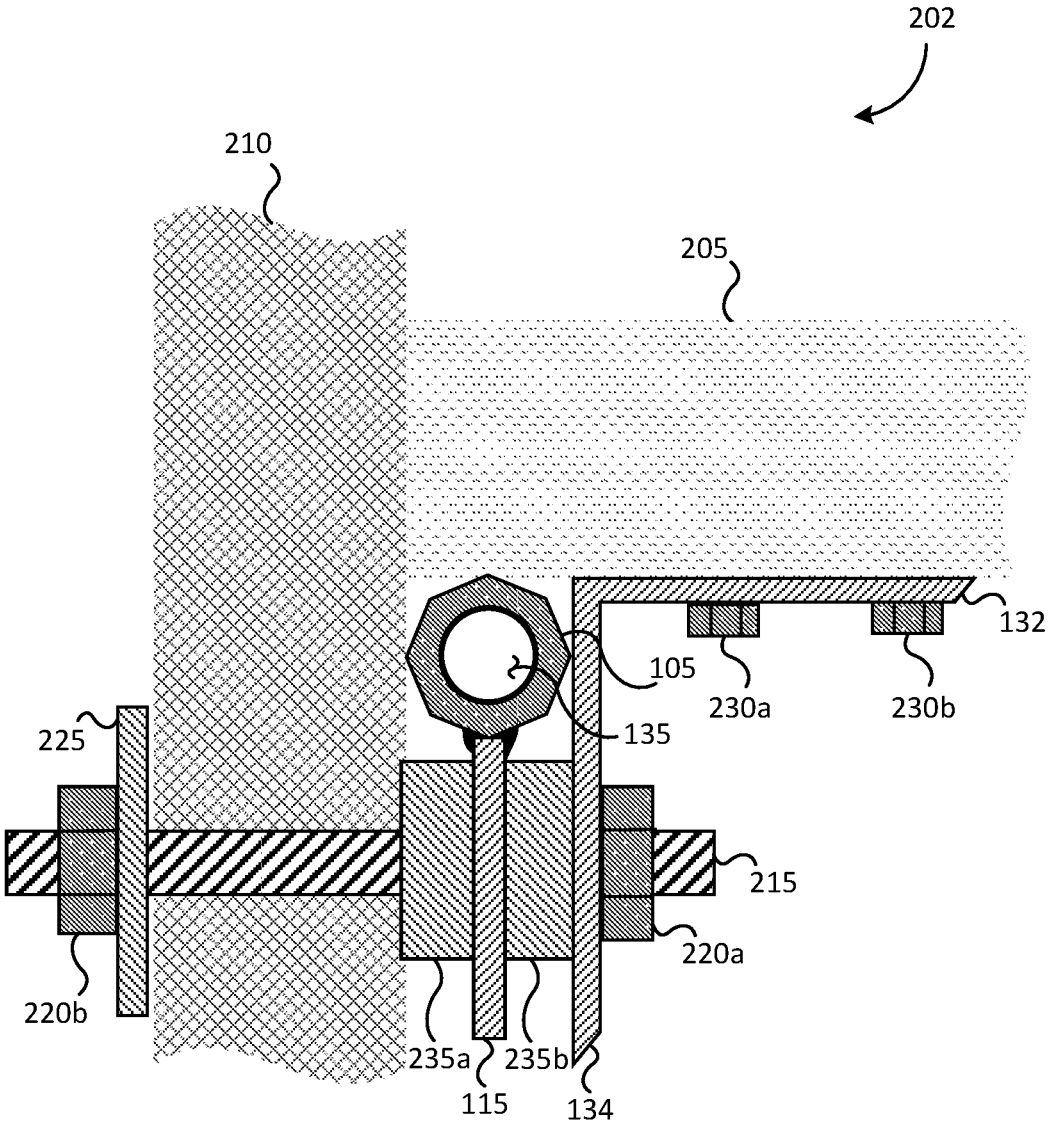
FIG. 2B illustrates a side view of an embodiment of an example system for securing a first structural building component to a second structural building component.

FIG. 2B illustrates a side view of another embodiment of a system 202 for securing a first structural building component to a second structural building component. The system 202 illustrated in FIG. 2B is provided for illustration only. Other examples of the system 202 may be used without departing from the scope of the present disclosure.

As shown in FIG. 2B, the system 202 includes the seismic washer 100, first arm 132 and second arm 134 of the seismic tie bracket 130, and the first and second structural building components 205, 210. However, the system 202 illustrates another embodiment of the arrangement between the seismic washer 100, the seismic tie bracket 130, and the second structural building component 210.

In the system 202 illustrated in FIG. 2B, the seismic washer 100 is provided outside, but still proximate to, the seismic tie bracket 130. In other words, the seismic washer 100 is provided outside of the angle bracket created by the intersection of the first arm 132 and the second arm 134, and between the second arm 134 and the second structural building component 210. In the embodiment of the system 202, intermediate washers 235*a*, 235*b* are provided between the second structural building component 210 and the plate washer 115 and between the plate washer 115 and the second arm 134 to provide additional support for the plate washer 115 and maintain structural integrity. For example, the first intermediate washer 235*a* is provided between the second structural building component 210 and the plate washer 115 and the second intermediate washer 235*b* is provided between the plate washer 115 and the second arm 134. It should be understood that the width of the intermediate washers 235*a*, 235*b* are such that, when placed between the second structural building component 210 and the plate washer 115 and between the plate washer 115 and the second arm 134, minimal or no gaps are present between the components of the system 202.

Figure 2C:
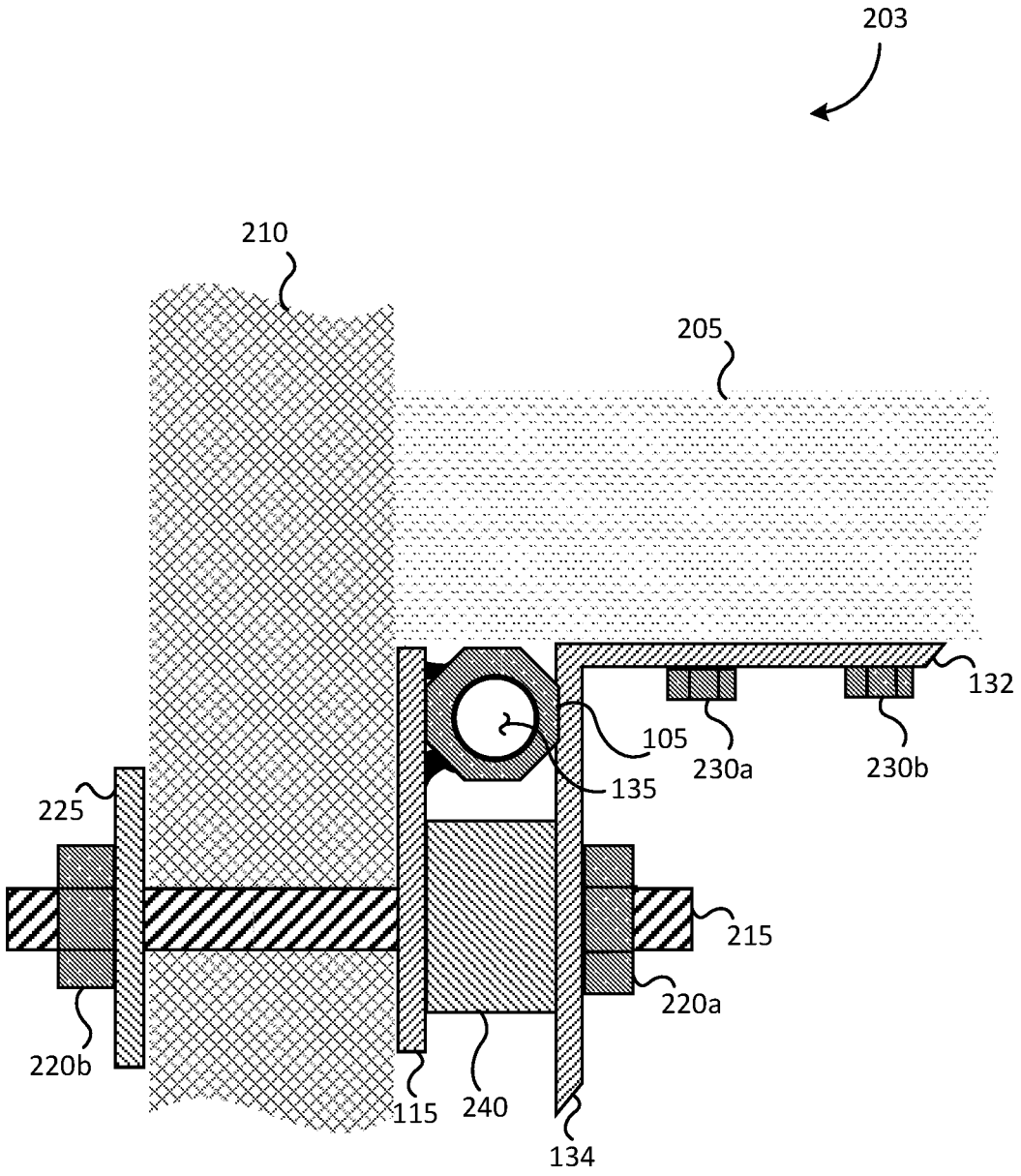
FIG. 2C illustrates a side view of an embodiment of an example system for securing a first structural building component to a second structural building component.

FIG. 2C illustrates a side view of an embodiment of a system 203 for securing a first structural building component to a second structural building component. The system 203 illustrated in FIG. 2C is provided for illustration only. Other examples of the system 203 may be used without departing from the scope of the present disclosure.

As shown in FIG. 2C, the system 203 includes the embodiment of the seismic washer 100 illustrated in FIG. 1D. For example, the plate washer 115 is offset relative to the threaded fastener 105 and the plate washer 115 is fastened to the threaded fastener 105 by a first fastener 126*a* and a second fastener 126*b*. Like the arrangement illustrated in the system 202, the seismic washer 100 is provided outside of the angle bracket created by the intersection of the first arm 132 and the second arm 134, and between the second arm 134 and the second structural building component 210. However, due to the offset arrangement of the threaded fastener 105 and the plate washer 115, only one intermediate washer 240 is implemented to maintain structural integrity. The offset arrangement of the plate washer 115 relative to the threaded fastener 105 enables the plate washer 115 to be placed proximate to the second structural building component 210 and the intermediate washer 240 is provided between the plate washer 115 and the second arm 134. It should be understood that the intermediate washer 240 includes a width approximately the same as a width of the threaded fastener 105 such that the intermediate washer 240 is provided immediately proximate to each of the plate washer 115 and the second arm 134, with minimal or no gaps between the components of the system 203.

Figure 3:
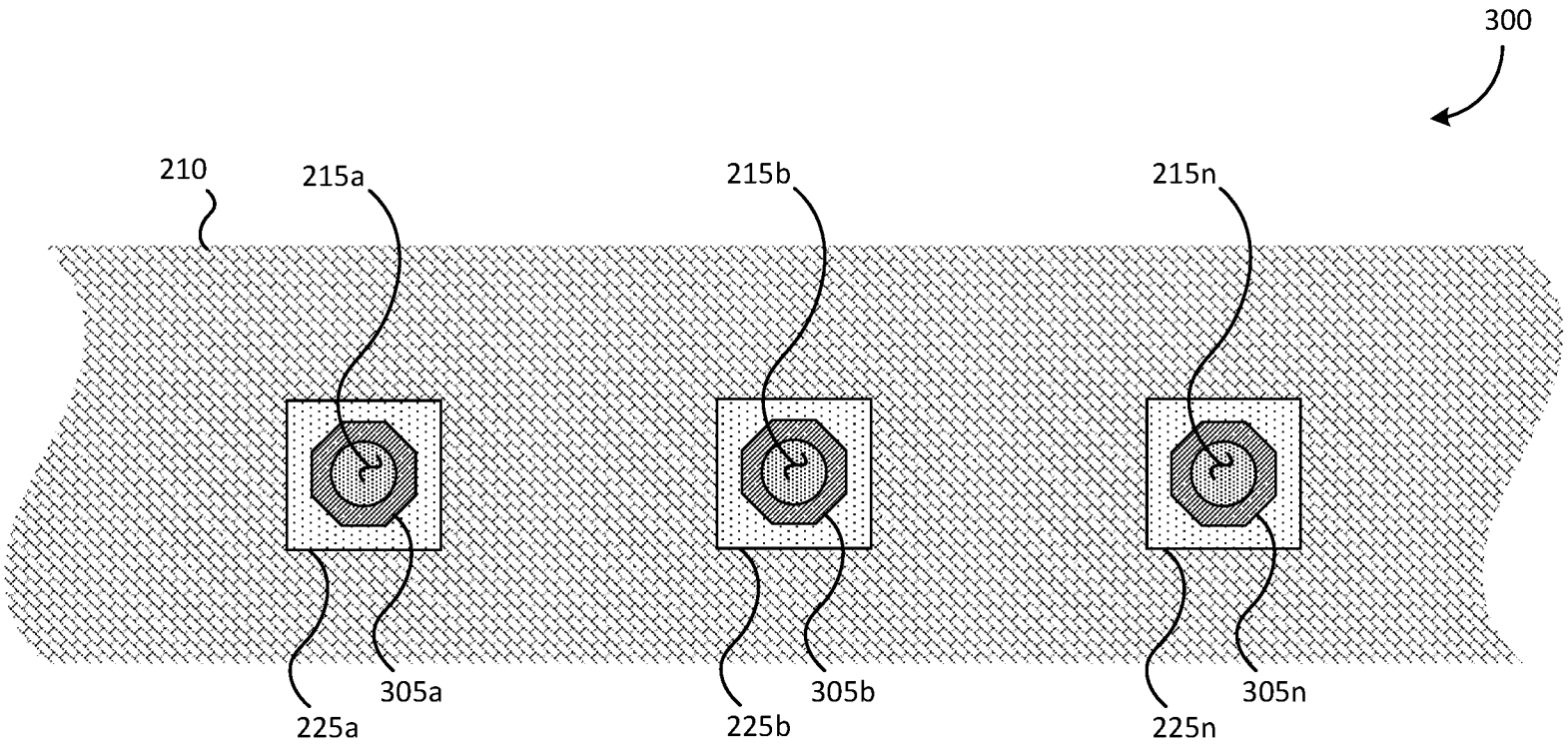
FIG. 3 illustrates an embodiment of an example exterior wall affixed to interior seismic tie brackets with fasteners, threaded rods, and washers.

Each of the various examples presented in FIGS. 2A-2C illustrate a single iteration of an intersection between the first structural building component 205 and the second structural building component 210 using the seismic washer 100 and the seismic tie bracket 130. However, in implementation, multiple iterations of the seismic washer 100 and the seismic tie bracket 130 may be implemented in series in order to provide additional stability to the structure. For example, iterations of the seismic washer 100 and the seismic tie bracket 130 may be implemented every four inches, six inches, twelve inches, eighteen inches, two feet, three feet, or four feet along the second structural building component 210 at the intersection with the first structural building component 205. For example, FIG. 3 illustrates an embodiment of an exterior wall affixed to interior seismic tie brackets with fasteners, threaded rods, and washers. The exterior wall 300 illustrated in FIG. 3 is provided for illustration only. Other examples of the exterior wall 300 may be used without departing from the scope of the present disclosure.

In some examples, the exterior wall 300 is an exterior of the second structural building component 210, where the interior of the second structural building component 210 intersects the first structural building component 205 as illustrated in FIGS. 2A-2C. FIG. 3 illustrates an example of three iterations of the seismic washer 100 and the seismic tie bracket 130 at the intersection between the second structural building component 210 and the first structural building component 205. For example, FIG. 3 illustrates a first threaded bolt 215*a* affixed to the exterior of the second structural building component 210 with a first washer 225*a* and a first fastener 305*a*, a second threaded bolt 215*b* affixed to the exterior of the second structural building component 210 with a second washer 225*b* and a second fastener 305*b*, and a third threaded bolt 215*n* affixed to the exterior of the second structural building component 210 with a third washer 225*n* and a third fastener 305*n*. Each of the first fastener 305*a*, the second fastener 305*b*, and the third fastener 305*n* may be an example of the second fastener 220*b* illustrated in FIGS. 2A-2C.

As described herein, the second structural building component 210 may include any number of threaded bolts 215*a*, 215*b*, 215*n* visible on the exterior wall 300. In other words, although three threaded bolts 215*a*, 215*b*, 215*n* are shown as visible on the exterior wall 300 in FIG. 3, a complete second structural building component 210 may include any number of threaded bolts 215 threaded through the opening 120 and opening 138 of a plate washer 115 and second arm 134, respectively, as described herein.

FIG. 4 illustrates a threaded bolt including a plurality of seismic washers. The threaded bolt 135 and seismic washers 100 illustrated in FIG. 4 are provided for illustration only. Other examples of the threaded bolt 135 and seismic washers 100 may be used without departing from the scope of the present disclosure.

FIG. 4 illustrates a threaded bolt 135 upon which a plurality of seismic washers 100 are threaded. For example, a first seismic washer 100*a*, a second seismic washer 100*b*, and a third seismic washer 100*n* are threaded on the threaded bolt 135 at equidistant intervals. More particularly, the threaded bolt 135 is disposed through the threaded fastener 105 of each of the first seismic washer 100*a*, the second seismic washer 100*b*, and the third seismic washer 100*n*. Each of the first seismic washer 100*a*, the second seismic washer 100*b*, and the third seismic washer 100*n* is configured to rotate, via the threads on the threaded bolt 135 and respective threaded fastener 105 of the seismic washer 100, on the threaded bolt 135 such that the plate washer 100 of each seismic washer 100 is provided parallel to the structural building component upon which the threaded bolt 135 and plurality of seismic washers 100 is fixed, such as the second structural building component 210.

FIG. 4 further illustrates a separate threaded bolt 215 threaded through the opening 120 of each seismic washer 100. For example, a first threaded bolt 215*a* is threaded through the opening 120 of the first seismic washer 100*a*, a second threaded bolt 215*b* is threaded through the opening 120 of the second seismic washer 100*b*, and a third threaded bolt 215*n* is threaded through the opening 120 of the third seismic washer 100*n*.

As illustrated in FIG. 4, the axis of the threaded bolt 135 is perpendicular, or approximately perpendicular to, the axis of each of the threaded bolts 215. This arrangement of the respective axes enables the seismic washer 100 to provide seismic structural support both through the second structural building component 210 and along and parallel to the first structural building component 205 with multiple iterations of the seismic washer along the second structural building component 210.

In some examples, depending on the arrangement of the first structural building component 205 and the second structural building component 210, a terminal threaded bolt 215, i.e., a first or last threaded bolt 215 in a series of threaded bolts 215, as illustrated in FIGS. 3 and 4, may meet another threaded bolt that may or may not be included in systems presented herein. In the event of the threaded bolt 215 intersecting with another bolt, or the fastener of the threaded bolt 215 intersecting with another fastener, various embodiments of the present disclosure provide cross-coupling fasteners in an arrangement that enable each of the threaded bolts to continue on their respective trajectories. For example, a corner where two exterior walls meet may result in one or more threaded bolts 215 intersecting or nearly intersecting.

Figure 5A:
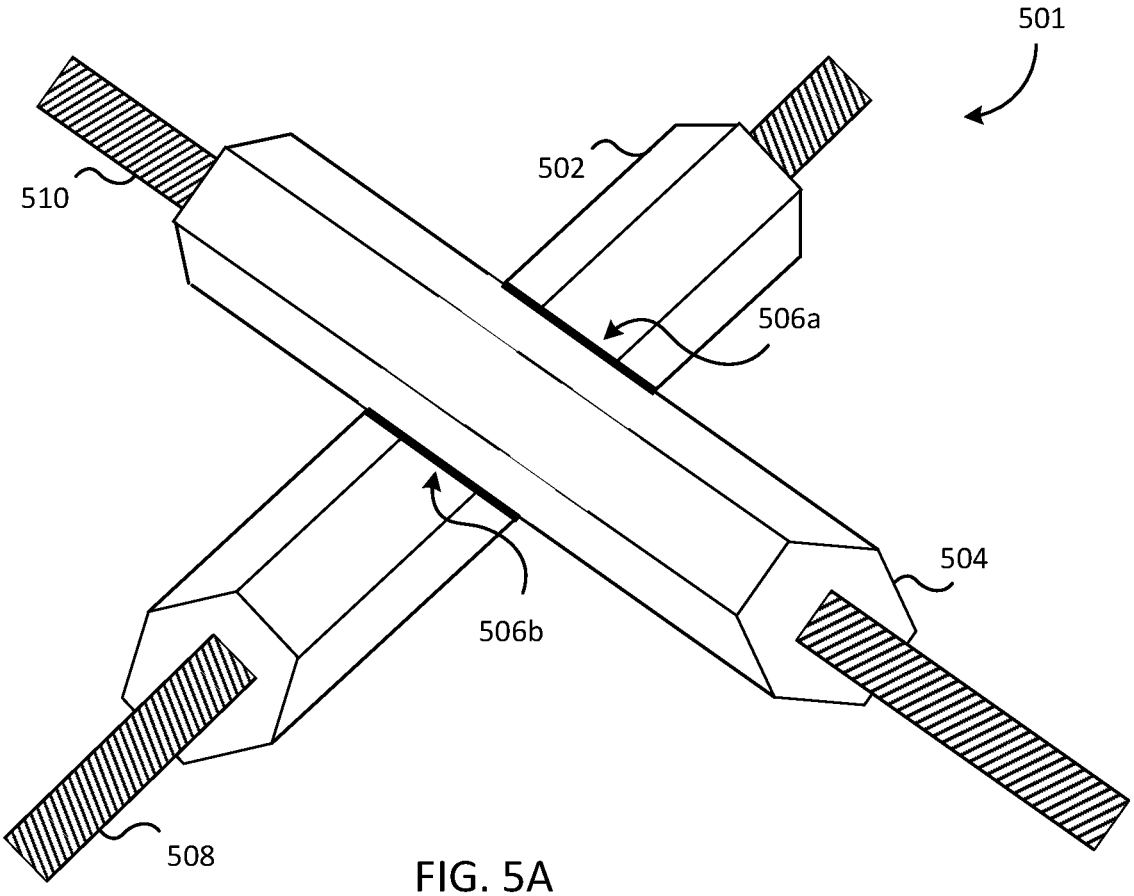
FIGS. 5A and 5B illustrate various embodiments of cross welded coupling fasteners.

For example, FIG. 5A illustrates an example of a universal cross-coupling fastener 501. The universal cross-coupling fastener 501 includes a first fastener 502 arranged substantially perpendicular to a second fastener 504. The first fastener 502 is fixedly attached to the second fastener 504 by a pair of welds 506*a*, 506*b*. The first weld 506*a* is provided on a first side of the second fastener 504 and the second weld 506*b* is provided on a second side of the second fastener 504. The welds 506 of the universal cross-coupling fastener 501 enable a first threaded bolt 508 to be threaded through an entirety of the first fastener 502 and a second threaded bolt 510 to be threaded through an entirety of the second fastener 504 without the first threaded bolt 508 affecting the second threaded bolt 510 and vice versa.

Figure 5B:
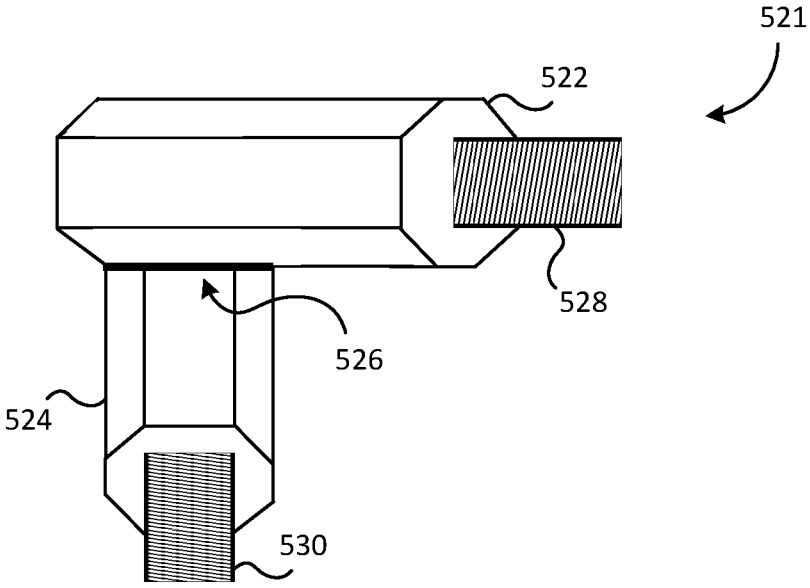

As another example, FIG. 5B illustrates an example of a precision corner coupling fastener 521. The precision corner coupling fastener 521 enables the coupling of the ends of two threaded bolts 528, 530. The first threaded bolt 528 is threaded into a first fastener 522 and the second threaded bolt 530 is threaded into a second fastener 524. The first fastener 522 is fixedly attached to the second fastener 524 by a weld 526 provided at the junction between the first fastener 522 and the second fastener 524.

Figure 6:
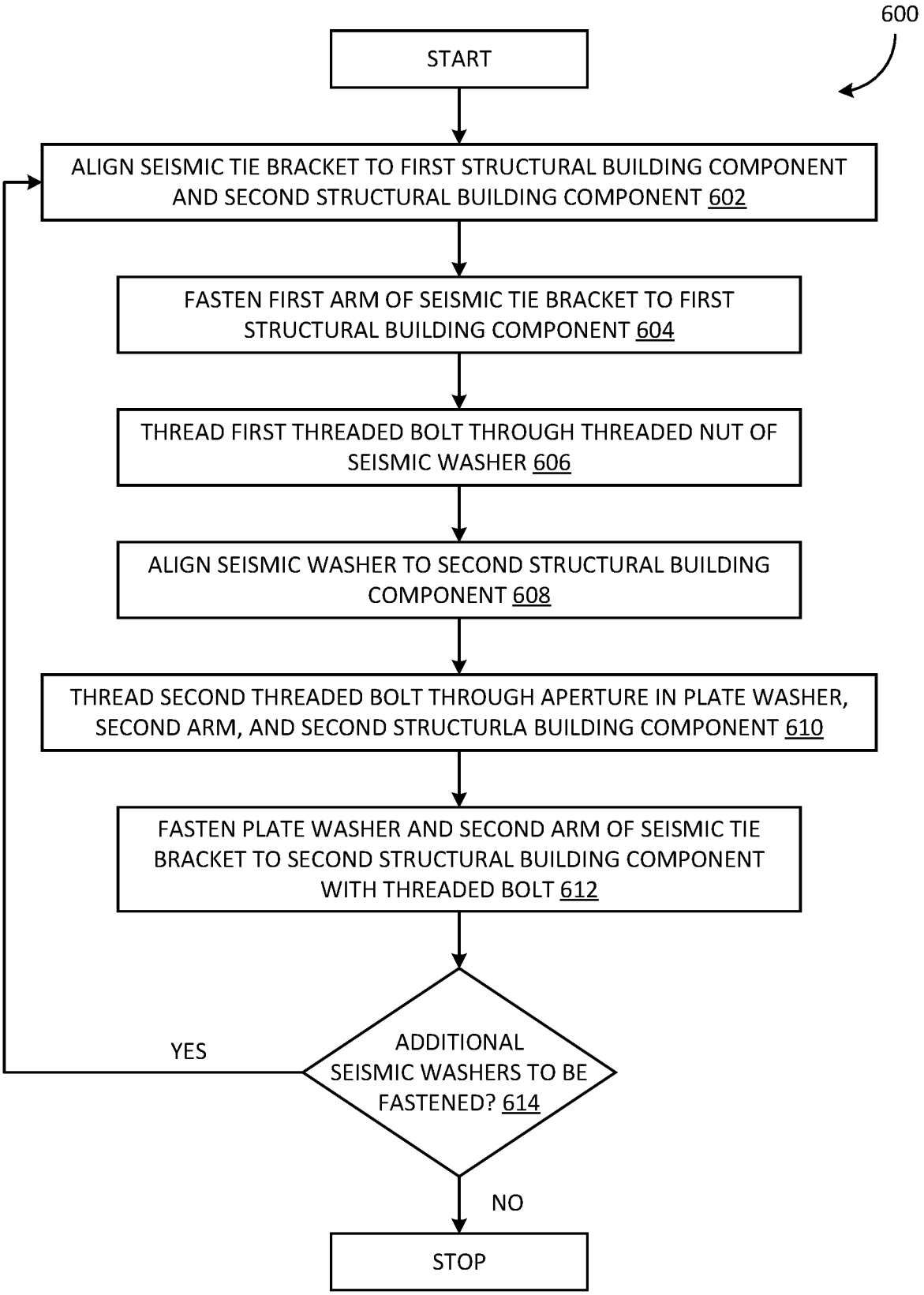
FIG. 6 is a flow chart illustrating an example method of securing a building floor to a wall using a seismic tie bracket and seismic washer.

FIG. 6 is a flow chart illustrating a method of securing a building floor to a wall using a seismic tie bracket and seismic washer. The method 600 of FIG. 6 is presented for illustration only and should not be construed. Various operations may be added, omitted, or performed in a different order without departing from the scope of the present disclosure.

The method 600 begins by aligning a first seismic tie bracket 130 to the first structural building component 205 and the second structural building component 210 in operation 602. The first arm 132 of the seismic tie bracket 130 is fasten to the first structural building component 205 in operation 604. For example, the first arm 132 may be fastened to the first structural building component 205 using one or more fasteners 230 as described herein.

In operation 606, a first threaded bolt, such as the threaded bolt 135, is threaded through the opening 110 of the threaded fastener 105 of a first seismic washer 100. In operation 608, the first seismic washer 100 is aligned to the second structural building component 210. For example, the first seismic washer 100 may be aligned such than an opening in the second structural building component 210 is aligned with the opening 120 of the plate washer. In operation 610, a second threaded bolt, such as the threaded bolt 215, is threaded through the opening 120 of the plate washer 115 of the first seismic washer 100, the opening 138 of the second arm 134, and the opening in the second structural building component 210. In operation 612, the plate washer 115 of the first seismic washer 100 and the second arm 134 are fastened to the second structural building component 210 with the threaded bolt 215, such as by tightening one or both of a first fastener 220*a* and a second fastener 220*b*.

In operation 614, it is determined whether additional seismic washers 100 and/or additional seismic tie brackets 130 are to be fastened to the first and second structural building components 205, 210. Where additional seismic washers 100 and seismic tie brackets 130 are to be fastened, the method 600 returns to operation 602 and aligns the next seismic tie bracket 130 to the first structural building component 205 and the second structural building component 210. Operations 602 through 614 are performed in sequence as described herein until, in operation 614, no additional seismic washers or seismic tie brackets 130 are determined to be fastened to the first and second structural building components 205, 210. When it is determined no additional seismic washers or seismic tie brackets 130 are determined to be fastened to the first and second structural building components 205, 210, the method 600 terminates.

Additional Examples

In another example, a seismic washer comprises a fastener comprising a first opening and a washer fixedly attached to and extending from the fastener, the washer including a second opening provided approximately perpendicular to the first opening. The second opening is configured to receive a bolt coupling the washer to a structural building component.

In some examples, a seismic retrofit system includes a seismic tie bracket comprising a first arm and a second arm, the first and second arms disposed in intersecting planes to form an angle bracket. The seismic retrofit system further includes a seismic washer comprising a fastener provided proximate to the intersection of the first and second arms, the fastener comprising a first opening. The seismic washer further includes a plate washer fixedly attached to and extending from the fastener, the washer including a second opening provided approximately perpendicular to the first opening. The second opening is configured to receive a bolt coupling the plate washer to a structural building component.

In some examples, the washer is a plate washer and the washer is welded to the fastener.

In some examples, a first bolt is disposed through the first opening.

In some examples, a second bolt is disposed through the second opening on an axis approximately perpendicular to the first bolt.

In some examples, the first bolt is threaded and the seismic washer is configured to rotate on the first bolt such that the washer is provided parallel to the structural building component.

In some examples, the first arm includes a third opening configured for a second fastener to attach the first arm to the structural building component, and the second arm includes a fourth opening configured to be used to attach the second arm to a second structural building component.

In some examples, the angle bracket is formed at a ninety-degree angle.

In some examples, an axis of the fastener is substantially parallel to the axis formed at the intersection of the first and second arms.

In some examples, the fastener is fixedly attached to the first and second arms of the seismic tie bracket proximate to the intersection of the first and second arms of the tie bracket.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

It will be understood that the benefits and advantages described above may relate to one example or may relate to several examples. The examples are not limited to those that solve any or all of the stated problems or those that have any or all of the stated benefits and advantages. It will further be understood that reference to 'an' item refers to one or more of those items.

The term "comprising" is used in this specification to mean including the feature(s) or act(s) followed thereafter, without excluding the presence of one or more additional features or acts.

The order of execution or performance of the operations in examples of the disclosure illustrated and described herein is not essential, unless otherwise specified. That is, the operations may be performed in any order, unless otherwise specified, and examples of the disclosure may include additional or fewer operations than those disclosed herein. For example, it is contemplated that executing or performing a particular operation before, contemporaneously with, or after another operation is within the scope of aspects of the disclosure.

When introducing elements of aspects of the disclosure or the examples thereof, the articles "a," "an," "the," and "said" are intended to mean that there are one or more of the elements. The terms "comprising," "including," and "having" are intended to be inclusive and mean that there may be additional elements other than the listed elements. The term "exemplary" is intended to mean "an example of." The phrase "one or more of the following: A, B, and C" means "at least one of A and/or at least one of B and/or at least one of C."

Having described aspects of the disclosure in detail, it will be apparent that modifications and variations are possible without departing from the scope of aspects of the disclosure as defined in the appended claims. As various changes could be made in the above constructions, products, and methods without departing from the scope of aspects of the disclosure, it is intended that all matter contained in the above description and shown in the accompanying drawings shall be interpreted as illustrative and not in a limiting sense.

The disclosed methods, apparatus, and systems should not be construed as limiting in any way. Instead, the present disclosure is directed toward all novel and nonobvious features and aspects of the various disclosed embodiments, alone and in various combinations and sub-combinations with one another. The disclosed methods, apparatus, and systems are not limited to any specific aspect or feature or combination thereof, nor do the disclosed embodiments require that any one or more specific advantages be present or problems be solved.

What is claimed is:

1. A seismic washer comprising:

a fastener comprising a first opening, and a washer fixedly attached to and extending from the fastener, the washer including a second opening provided approximately perpendicular to the first opening, wherein the second opening is configured to receive a bolt coupling the washer to a structural building component.

2. The seismic washer of claim 1, wherein:

the washer is a plate washer, and the washer is welded to the fastener.

3. The seismic washer of claim 1, wherein:

the fastener is threaded, and the fastener is fixedly attached to a seismic tie bracket.

4. The seismic washer of claim 1, wherein the first opening is configured to receive a rod approximately perpendicular to an axis of the bolt.

5. A seismic retrofit system, comprising:

a seismic tie bracket comprising a first arm and a second arm, the first and second arms disposed in intersecting planes to form an angle bracket; and a seismic washer comprising:

a fastener provided proximate to the intersection of the first and second arms, the fastener comprising a first opening, and a washer fixedly attached to and extending from the fastener, the washer including a second opening provided approximately perpendicular to the first opening, wherein the second opening is configured to receive a bolt coupling the washer to a structural building component.

6. The seismic retrofit system of claim 5, wherein:

the washer is a plate washer, and the washer is welded to the fastener.

7. The seismic retrofit system of claim 5, further comprising a first bolt disposed through the first opening.

8. The seismic retrofit system of claim 7, further comprising a second bolt disposed through the second opening on an axis approximately perpendicular to the first bolt.

9. The seismic retrofit system of claim 7, wherein the first bolt is threaded and the seismic washer is configured to rotate on the first bolt such that the washer is provided parallel to the structural building component.

10. The seismic retrofit system of claim 5, wherein:

the first arm includes a third opening configured for a second fastener to attach the first arm to the structural building component, and the second arm includes a fourth opening configured to be used to attach the second arm to a second structural building component.

11. The seismic retrofit system of claim 5, wherein the angle bracket is formed at a ninety-degree angle.

12. The seismic retrofit system of claim 5, wherein an axis of the fastener is substantially parallel to the axis formed at the intersection of the first and second arms.

13. The seismic retrofit system of claim 5, wherein the fastener is fixedly attached to the first and second arms of the seismic tie bracket proximate to the intersection of the first and second arms of the tie bracket.

14. A seismic retrofit system, comprising:

a plurality of tie brackets, each seismic tie bracket comprising a first arm and a second arm, the first and second arms disposed in intersecting planes to form an angle bracket;

a plurality of seismic washers, each seismic washer comprising:

a fastener provided proximate to the intersection of the first and second arms of one of the tie brackets, the fastener comprising a first opening, and a washer fixedly attached to and extending from the fastener, the washer including a second opening provided approximately perpendicular to the first opening; and a bolt disposed through the fastener of each of the plurality of seismic washers.

15. The seismic retrofit system of claim 14, wherein each seismic washer of the plurality of seismic washers is configured to rotate on the bolt such that the washer of each seismic washer of the plurality of seismic washers is provided parallel to a structural building component.

16. The seismic retrofit system of claim 15, further comprising a plurality of second bolts, wherein each second bolt is disposed through the second opening of a respective seismic washer on an axis approximately perpendicular to the bolt.

17. The seismic retrofit system of claim 15, wherein each second bolt is provided parallel to each other second bolt.

18. The seismic retrofit system of claim 14, wherein:

the first arm of each tie bracket includes a third opening configured for a second fastener to attach the first arm to a first structural building component, and the second arm of each tie bracket includes a fourth opening configured to be used to attach the second arm to a second structural building component.

19. The seismic retrofit system of claim 14, wherein each of the angle brackets is formed at a ninety-degree angle.

20. The seismic retrofit system of claim 14, wherein the fastener of each seismic washer is fixedly attached to the first and second arms of one of the tie brackets proximate to the intersection of the first and second arms of the tie bracket.

* * * * *